US006243553B1

(12) United States Patent
Lee et al.

(10) Patent No.: US 6,243,553 B1
(45) Date of Patent: Jun. 5, 2001

(54) METHOD FOR CLEANING THE DEVELOPER FOR A LIQUID ELECTROPHOTOGRAPHIC PRINTER

(75) Inventors: Jin-soo Lee, Seoul; Chang-soo Lee; Jin-geun Kwak, both of Suwon, all of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/466,913

(22) Filed: Dec. 20, 1999

(30) Foreign Application Priority Data

Dec. 18, 1998 (KR) ..... 98-56195
Jun. 4, 1999 (KR) ..... 99-20687

(51) Int. Cl.[7] ..... G03G 15/10
(52) U.S. Cl. ..... 399/249
(58) Field of Search ..... 399/237, 240, 399/249, 57, 348, 234, 245, 246, 235

(56) References Cited

U.S. PATENT DOCUMENTS

Re. 31,964 * 8/1985 Schaefer et al. ..... 399/56
4,311,780 * 1/1982 Mochizuki et al. ..... 430/125
4,400,079 * 8/1983 Landa ..... 399/240
4,833,500 * 5/1989 Mochizuki et al. ..... 399/55
5,598,253 * 1/1997 Yagi ..... 399/240
5,689,780 * 11/1997 Tamura et al. ..... 399/249
5,805,963 * 9/1998 Teschendorf et al. ..... 399/249

FOREIGN PATENT DOCUMENTS 4-156485 5/1992 (JP) ..... G03G/15/10
6-314030 11/1994 (JP) ..... G03G/15/10
8-6404 1/1996 (JP) ..... G03G/15/10

* cited by examiner

*Primary Examiner*—Robert Beatty
(74) *Attorney, Agent, or Firm*—Sughrue, Mion, Zinn, Macpeak & Seas, PLLC

(57) ABSTRACT

A developer cleaning method for a liquid electrophotographic printer is achieved by developing an electrostatic latent image by supplying developer supplied from an injection nozzle to a photoreceptor medium via a development roller, removing drip developer formed on the photoreceptor web between a squeegee roller and the development roller, removing developer remaining between the injection nozzle and the development roller, and reducing an electrical potential of the development roller after development so that toner particles included in the drip developer are transferred to the development roller due to a difference in electrical potential.

6 Claims, 7 Drawing Sheets

METHOD FOR CLEANING THE DEVELOPER FOR A LIQUID ELECTROPHOTOGRAPHIC PRINTER

BACKGROUND OF THE INVENTION

1. Field of the Invention

The present invention relates to a developer cleaning method in a liquid electrophotographic printer, and more particularly, to a developer cleaning method for a liquid electrophotographic printer for removing powdered toner particles from the developer remaining on a photoreceptor medium and a development roller, after termination of a development mode, so that contamination of the photoreceptor medium and a transfer roller can be reduced.

2. Description of the Related Art

In general, a liquid electrophotographic printer such as a laser printer or copier develops an electrostatic latent image formed on a photoreceptor medium such as a photoreceptor web, using developer. The developed image is transferred to a sheet of paper via a transfer roller. The developer is formed by mixing toner powder having a predetermined color, and a liquid carrier.

Referring to FIG. 1, a conventional liquid electrophotographic printer includes a photoreceptor web 10 circulating by being supported by a plurality of guide rollers 11. In a development mode, while the photoreceptor web 10 circulates, a surface of the photoreceptor web 10 is charged to an electrical potential of about 600 V by a main corona 12. Subsequently, the charged surface of the photoreceptor web 10 is charged to an exposure electrical potential of about 150 V by a beam scanned by a laser scanning unit (LSU) 13 according to image signals so that an electrostatic latent image is formed. Reference numeral 28 denotes a topping corona for increasing the electrical potential of the photoreceptor web 10 lowered after passing a development unit 20 so that the electrical potential thereof can be maintained constantly.

Also, as shown in FIG. 2, developer is injected from an injection nozzle 23 toward the outer circumference of a development roller 22. The developer is transferred from the outer circumference of the development roller 22 to an area for the electrostatic latent image charged to an exposure electrical potential lower than that of the development roller 22 due to the difference in electrical potential, to develop the electrostatic latent image.

Extra developer on the surface of the photoreceptor web 10 is removed by a squeegee roller 24. The developed image is dried by a drying unit 15 and then transferred to a transfer roller 16 due to the difference in a surface energy. The transferred image is printed on a sheet of paper P passing between the transfer roller 16 and a fixation roller 17.

When the development mode is terminated, the supply of developer from the injection nozzle 23 is stopped. In a state in which a development electrical potential is continuously applied to the development roller 22, as shown in FIG. 3, the development roller 22 is lowered a predetermined distance and developer D dripping from the photoreceptor web 10 is removed. For this, the squeegee roller 24 is reversed in a state in which the pressing force of the squeegee roller 24 to the photoreceptor web 10 is reduced. Then, the developer D is removed from the photoreceptor web 10 by the squeegee roller 24 and cleaned by a squeegee blade 26 contacting the squeegee roller 24.

Reference numeral 25 denotes a cleaning blade installed at the injection nozzle 23 for cleaning developer adhering to the outer circumference of the development roller 22 and reference numeral 27 denotes a brush roller for cleaning the outer circumferential surface of the development roller 22 by rotating in contact with the development roller 22.

However, remaining developer B remains, as shown in FIG. 4, at a contact portion between the squeegee roller 24 and the squeegee blade 26 after the drip developer D removing mode is terminated. The remaining developer B contains toner particles of about 3–3.5 wt % which causes to contaminate the photoreceptor web 10 and the transfer roller (16 of FIG. 1) in the subsequent development mode.

Also, when the supply of developer is stopped as the development mode is terminated, developer already supplied remains due to a surface tension between the injection nozzle 23, the development roller 22 and the cleaning blade 25. As the remaining developer is hardened as the time passes, the image area is contaminated in the subsequent print mode.

SUMMARY OF THE INVENTION

To solve the above problems, it is an object of the present invention to provide a developer cleaning method for a liquid electrophotographic printer in which the content of toner in the developer remaining on the photoreceptor web between the development roller and the squeegee roll is reduced to reduce contamination of the photoreceptor web and the transfer roller.

Also, it is another object of the present invention to provide a developer cleaning method for a liquid electrophotographic printer by which the developer remaining between the injection roller and development roller can be removed.

Accordingly, to achieve the above objective, there is provided a developer cleaning method for a liquid electrophotographic printer including the steps of developing an electrostatic latent image by supplying developer supplied from an injection nozzle to a photoreceptor medium via a development roller, removing drip developer formed on the photoreceptor web between a squeegee roller and the development roller, and reducing an electrical potential of the development roller after development so that toner particles included in the drip developer is transferred to the development roller due to a difference in electrical potential.

It is preferred in the present invention that the step of reducing an electrical potential includes the sub-steps of maintaining a constant charged electrical potential of the photoreceptor web and making the electrical potential difference between the development roller and the photoreceptor web to be equal to or greater than the electrical potential difference between the development roller and the electrostatic latent image.

Also, it is preferred in the present invention that the step of removing developer remaining between the injection nozzle and the development roller includes the sub-steps of continuously driving the photoreceptor web and the development roller after supply of the developer is terminated, transferring the developer remaining between the injection nozzle and the development roller to the development roller, and removing the transferred developer by a brush roller and a cleaning blade contacting the development roller.

Also, it is preferred in the present invention that the step of removing drip developer includes the sub-steps of lowering the development roller such that the development roller cannot contact the drip developer, decelerating the proceeding speed of the photoreceptor web, reducing a pressing force against the photoreceptor web by the squeegee roller, allowing a squeegee blade for removing developer on the outer circumferential surface of the squeegee roller, to contact the squeegee roller, and reversing the squeegee roller.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE PREFERRED EMBODIMENTS

Figure 1:
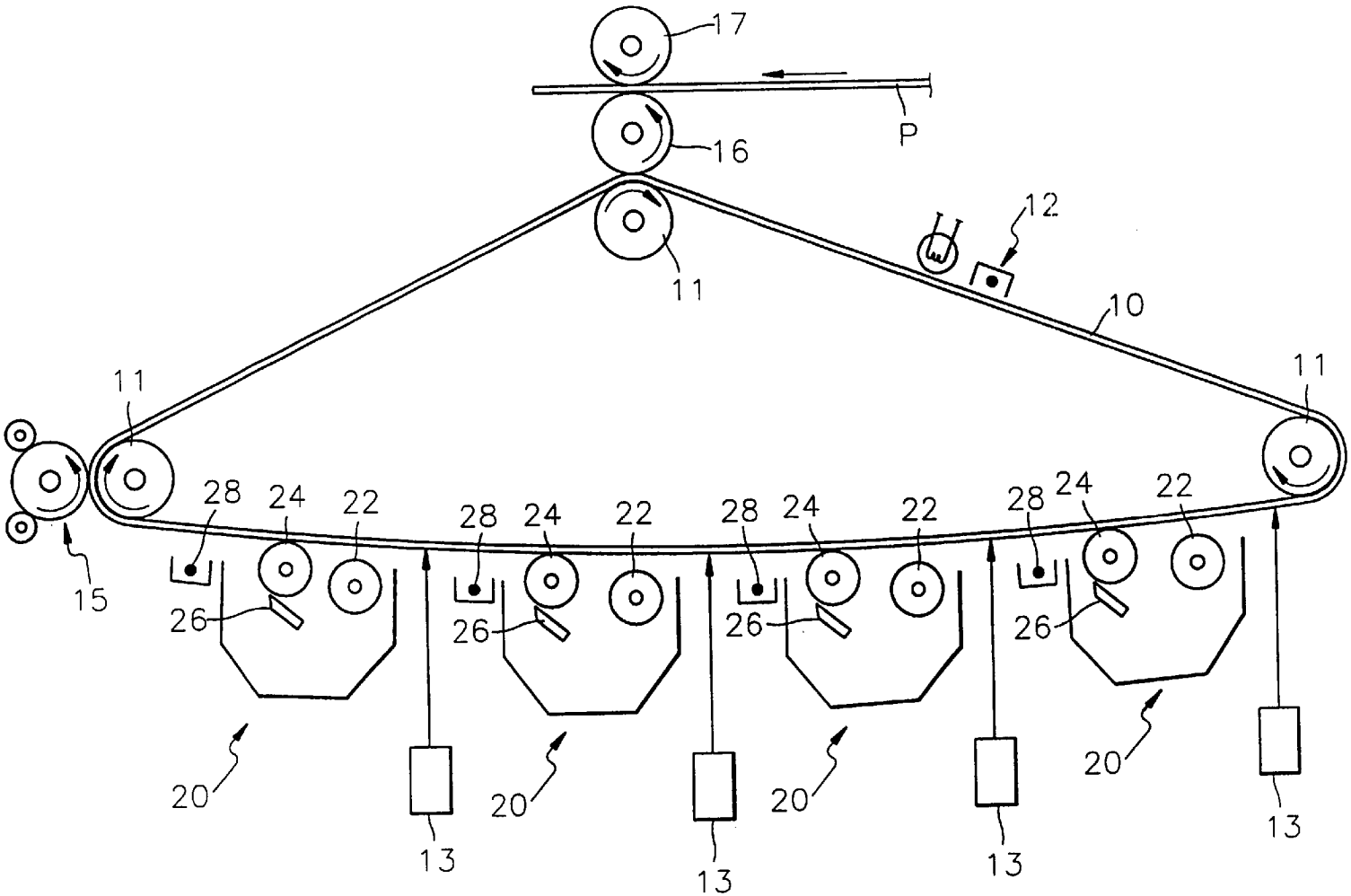
FIG. 1 PRIOR ART
FIG. 1 is a view showing the structure of a conventional liquid electrophotographic printer.
Figure 2:
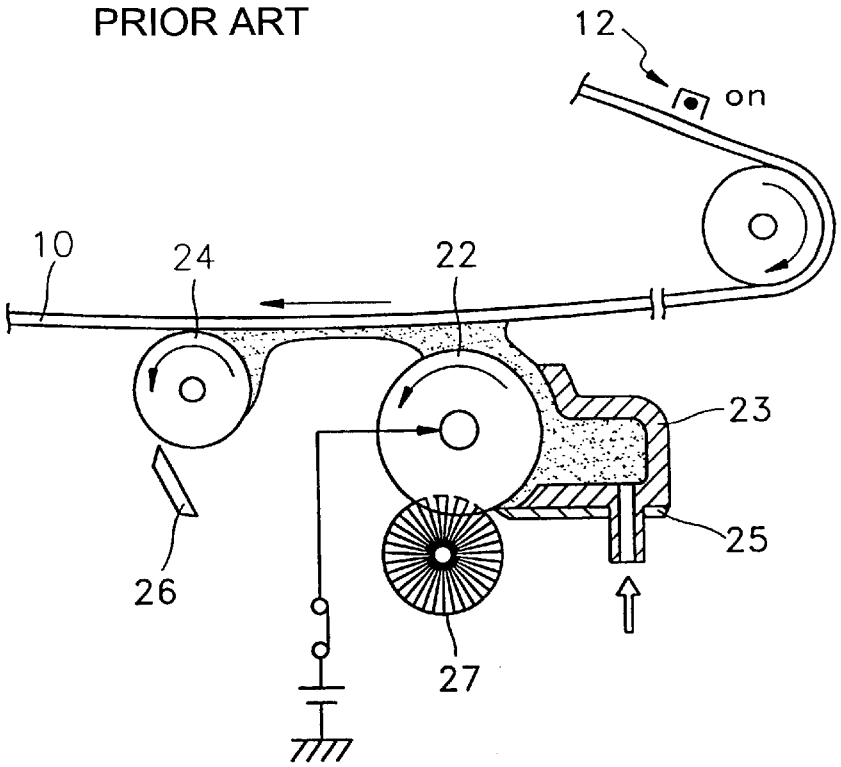
FIG. 2 PRIOR ART
FIG. 2 is a view showing a development unit of the printer shown in FIG. 1 in a development mode.
Figure 3:
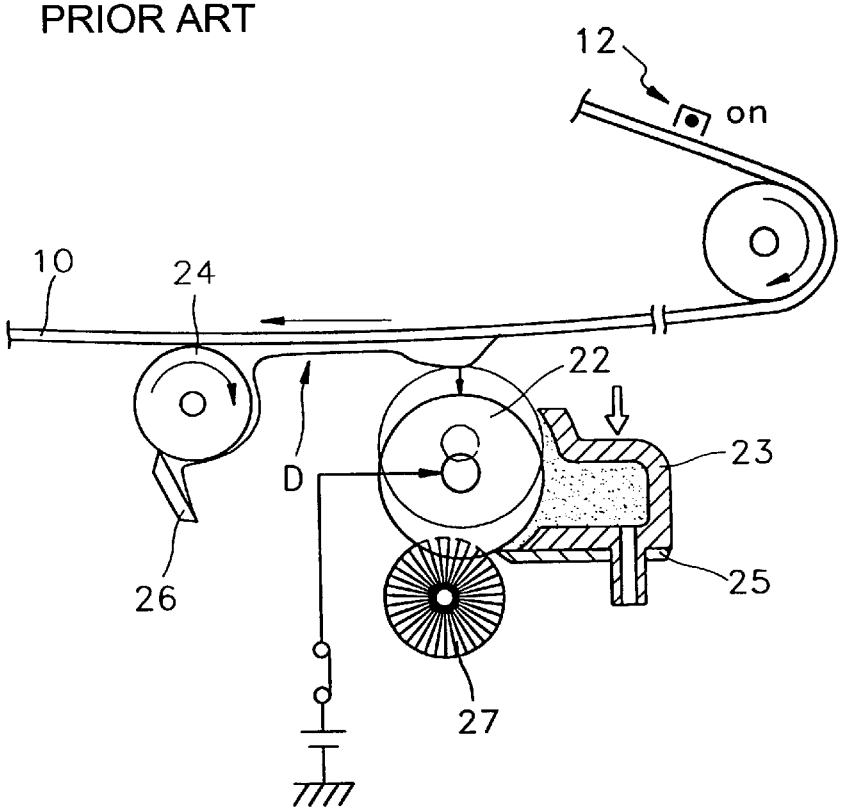
FIG. 3 PRIOR ART
FIG. 3 is a view showing the development unit of FIG. 2 in a drip developer removing mode.
Figure 4:
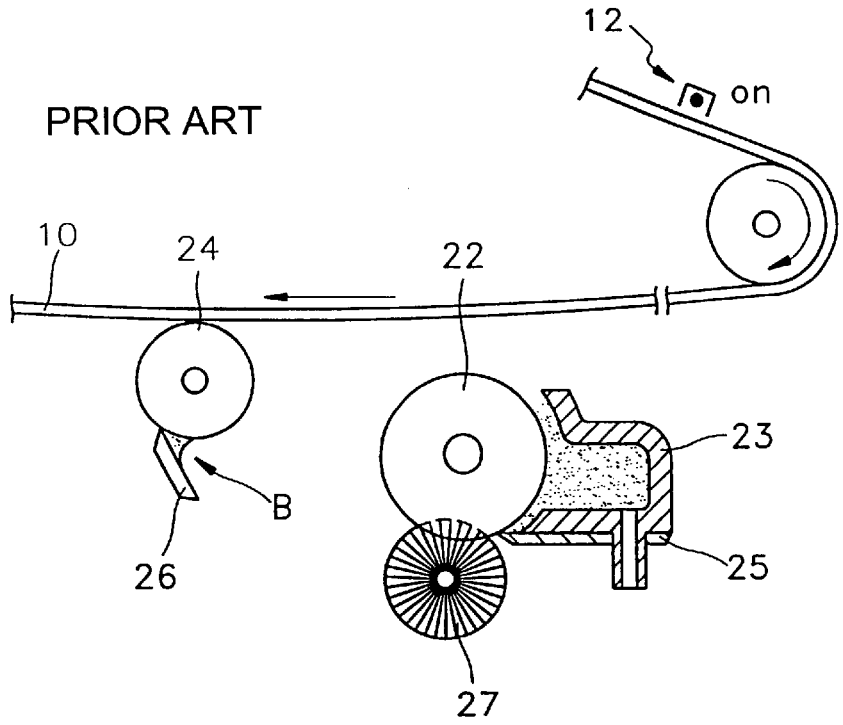
FIG. 4 PRIOR ART
FIG. 4 is a view showing the development unit of FIG. 2 after the drip developer removing mode is terminated.

Referring to FIGS. 5, 6, 7, 8A, 8B and 9, a developer cleaning method for a liquid electrophotographic printer according to a preferred embodiment of the present invention is described. Here, the same reference numerals indicate the same members having the same functions.

When the printer is turned on, the main corona 12 is driven to charge the photoreceptor web 10 to a charged electrical potential $V_H$ of about 600 V. The photoreceptor web 10 rotates 2–3 turns at a predetermined speed of 2 turn/20 sec for a warming up (W/U) period (S110). Then, the printer performs a development mode in which an image is formed on the photoreceptor web 10 (S120).

In the development mode step (S120), an electrostatic latent image is formed on the photoreceptor web 10 circulating as the charged electrical potential $V_H$ of the photoreceptor web 10 is changed to an exposure electrical potential $V_L$ of about 150 V by a light ray scanned by the laser scanning unit 13 according to video signals. Also, a development electrical potential $V_D$ of about 450 V is applied to the development roller 22.

While the electrostatic latent image is formed, the development roller 22 and the squeegee roller 24 ascend. Thus, the squeegee roller 24 contacts the photoreceptor web 10 with a predetermined pressure and a development gap is maintained between the development roller 22 and the photoreceptor web 10.

In these circumstances, developer supplied from the injection nozzle 23 to the outer circumference of the development roller 22 is transferred to the electrostatic latent image area due to the difference in electrical potential $\Delta V_1$ between the development electrical potential $V_D$ and the exposure electrical potential $V_L$ to develop the electrostatic latent image. Extra developer is removed from the photoreceptor web 10 by the squeegee roller 24 in a well-known method. The development mode step (S120) continues for a development mode (D/M) period according to video data to be printed.

Figure 5:
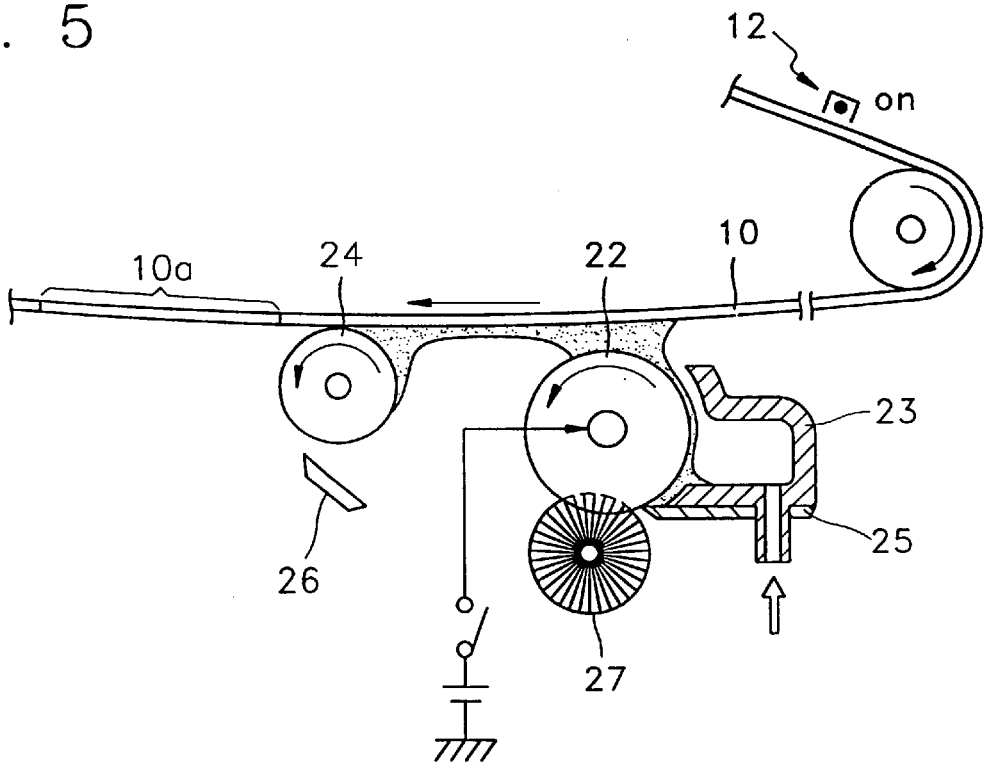
FIG. 5 is a view showing the structure of a development unit for explaining a state of removing the drip developer according to a developer cleaning method for a liquid electrophotographic printer according to a preferred embodiment of the present invention.

In step S130, whether there is another video data is checked and the termination of the development mode is determined. That is, when no more video data exists, as shown in FIG. 5, the supply of the developer is stopped and the laser scanning unit 13 is turned off. The charger 12 continues to be turned on so that the photoreceptor web 10 maintains the charged electrical potential $V_H$.

Next, in step S141, the electrical potential of the development roller 22 is lowered or the supply of an electrical potential to the development roller 22 is stopped so that an electrical potential difference $\Delta V_2$ equal to or greater than the development electrical potential difference $\Delta V_1$ is generated between the development roller 22 and the photoreceptor web 10. In this state, the developer transferred to the photoreceptor web 10 from the development roller 22 due to the development electrical potential difference $\Delta V_1$ returns to the development roller 22 due to the electrical potential difference $\Delta V_2$. Thus, as charged toner particles included in the developer D remaining on the photoreceptor web 10 move toward the development roller 22, the amount of toner particles in the developer D decreases. Also, when the development roller 22 is continuously rotated in the state in which the electrical potential of the development roller 22 is lowered, the developer remaining between the development roller 22, the injection nozzle 23 and the cleaning blade 25 is transferred to the development roller 22. The toner particles transferred to the development roller 22 and the remaining developer are removed by the brush roller 27 and the cleaning blade 25, respectively.

In step S143, it is determined whether the photoreceptor web 10 circulates at least one turn to secure removal of the remaining developer. Step S140 continues for a developer removing period C1. The photoreceptor web 10 circulates at the same speed for both the warming up (W/U) period and the development mode (D/M) period.

Figure 6:
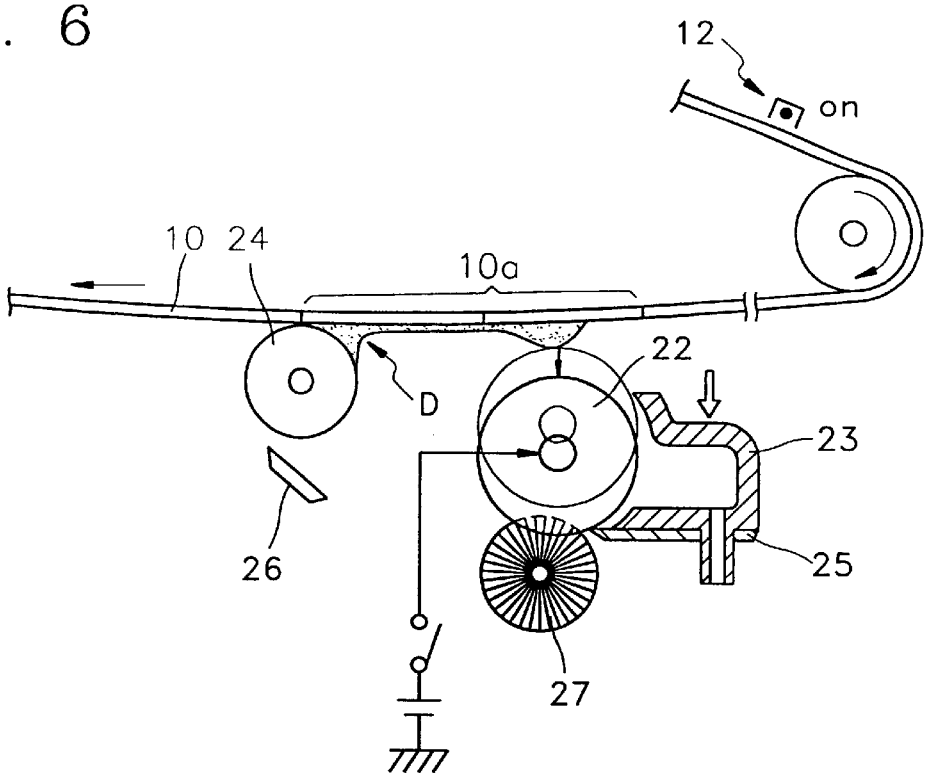
FIGS. 6 and 7 are views of the development unit of FIG. 5 in a drip developer removing mode.

When it is determined that the photoreceptor web 10 circulates one or more turns in step S143, the drip developer D is removed. Prior to the removal of the drip developer, to protect an image area of the photoreceptor web 10, it is determined whether the squeegee roller 24 contacts a non-image area 10*a* of the photoreceptor web 10 (S160). If the squeegee roller 24 does not contact the non-image area 10*a*, the photoreceptor web 10 is driven to circulate such that the drip developer D is located corresponding to the non-image area 10*a*, as shown in FIG. 6.

Next, the drip developer D is removed in step S170. In sub-step S171, the development roller 22 is lowered such that the drip developer D and the development roller 22 do not contact each other. In sub-step S171, the development rollers 22 provided by colors can be lowered concurrently at a lowering period $D_1$ at the same time period or sequentially by colors according to the proceeding direction of the photoreceptor web 10.

Also, in sub-step S173, the proceeding speed of the photoreceptor web 10 is preferably decelerated to 0.8 inch/sec. In sub-step S175, the pressing force against the photoreceptor web 10 by the squeegee roller 24 provided by colors is sequentially reduced in a pressure reducing period (P/D) according to the proceeding of the photoreceptor web 10.

Figure 7:
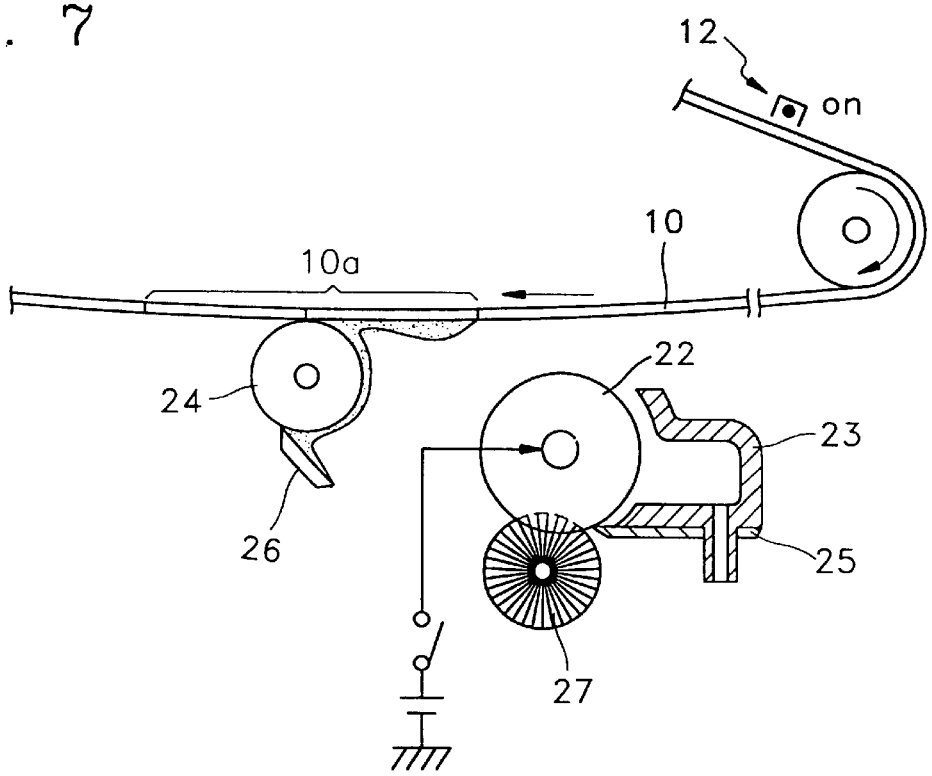
Figure 8A:
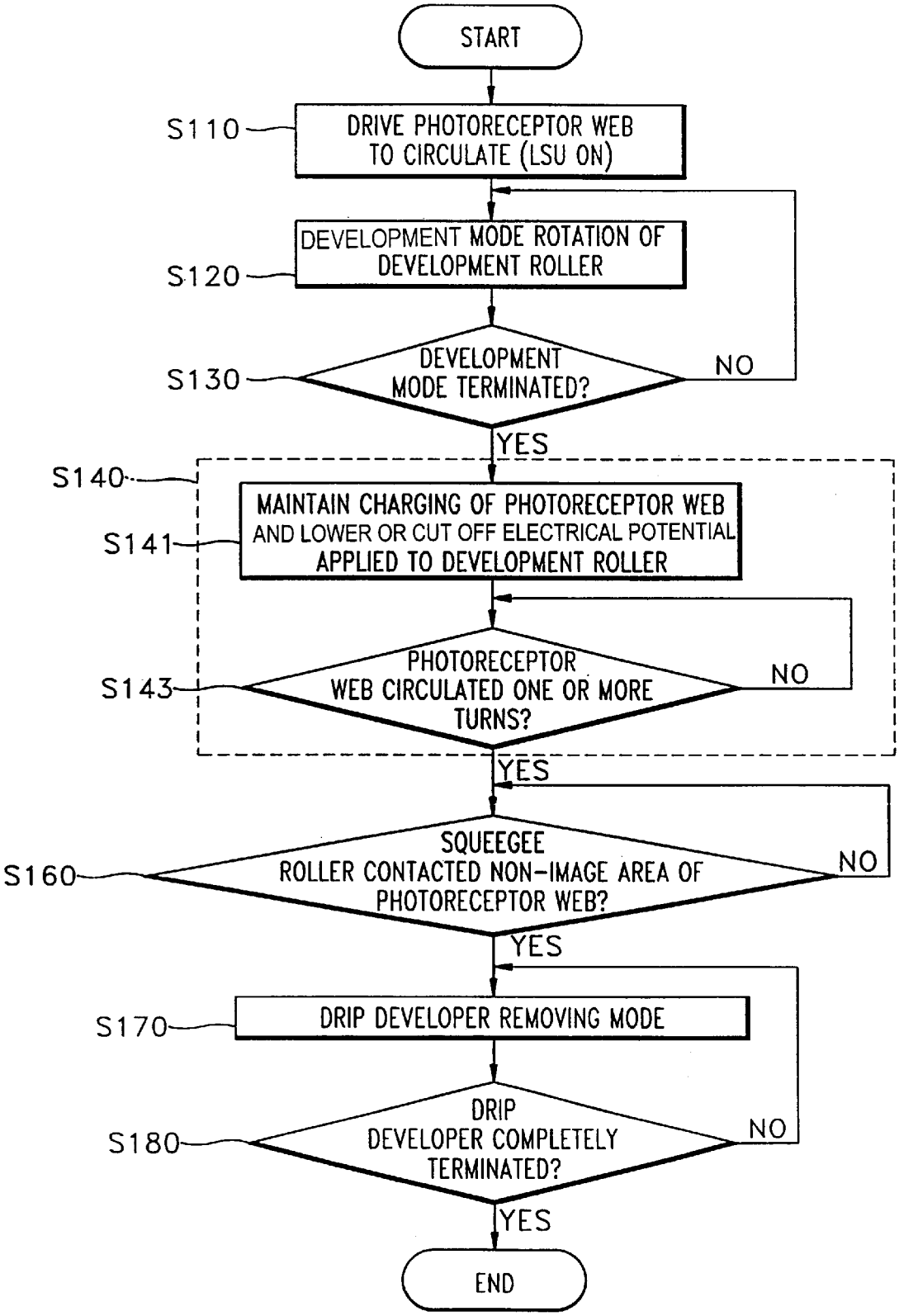
FIG. 8A is a flowchart for explaining a developer cleaning method for a liquid electrophotographic printer according to a preferred embodiment of the present invention.
Figure 8B:
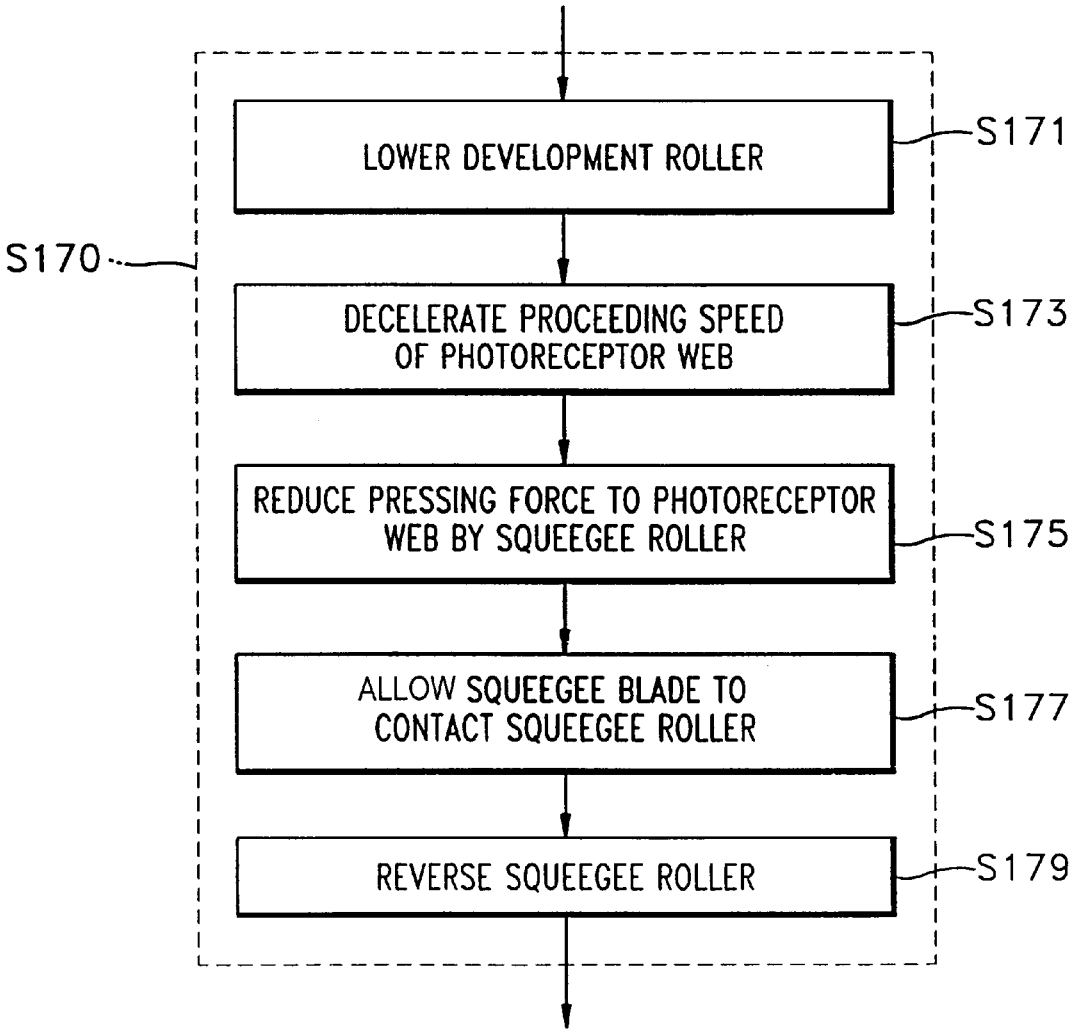
FIG. 8B is a flowchart for explaining the drip developer removing mode of FIG. 8A.
Figure 9:
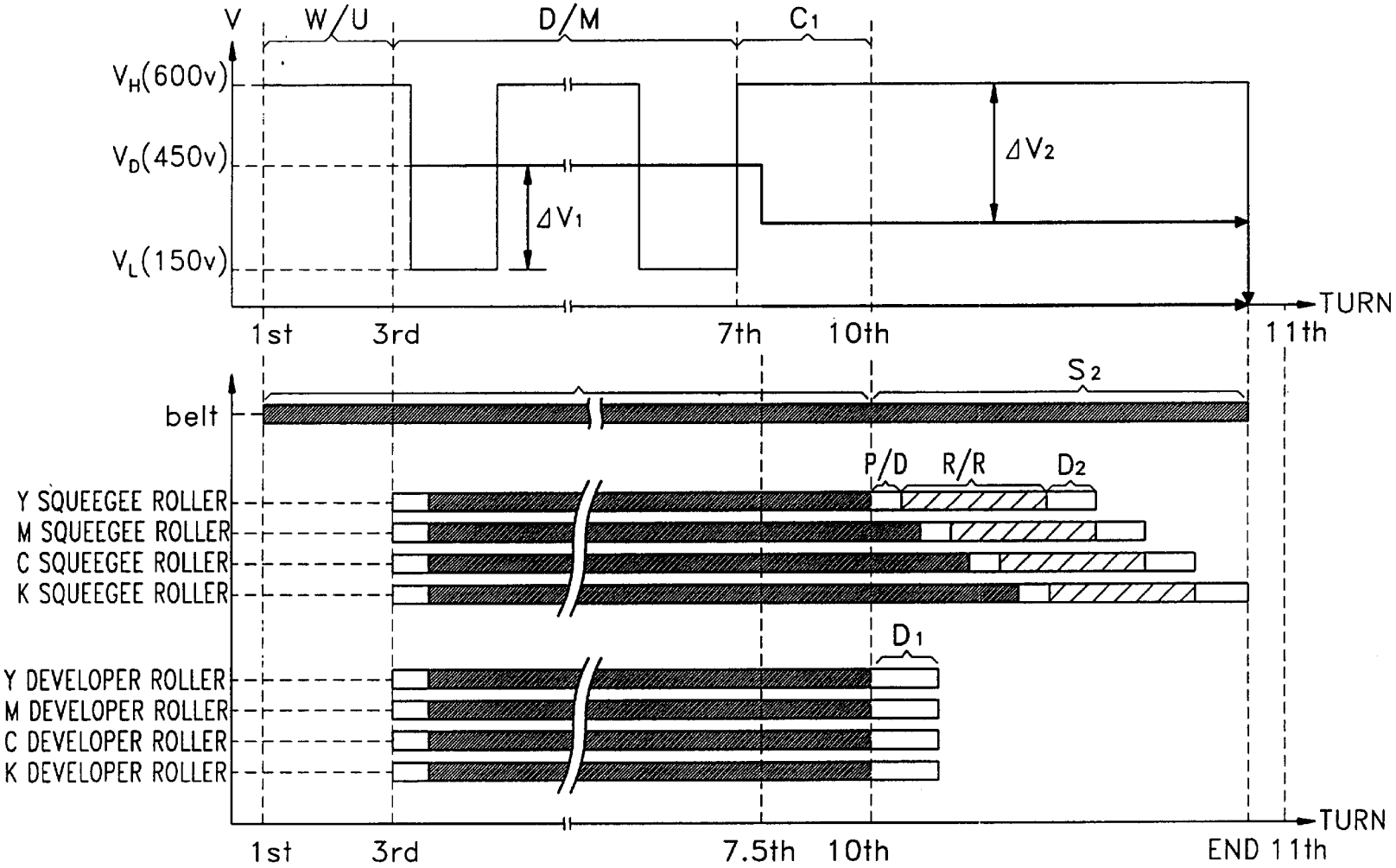
FIG. 9 is a timing chart for explaining the cleaning operation according to the cleaning method shown in FIGS. 8A and 8B.

As shown in FIG. 7, the squeegee blade 26 contacts the squeegee roller 24 in sub-step S177, and the squeegee roller 24 by colors is sequentially reversed in a reverse rotation period (R/R) in sub-step S179. Thus, the drip developer D is transferred to the outer circumferential surface of the squeegee roller 24 from the photoreceptor web 10 and is cleaned by the squeegee blade 26.

As the squeegee roller 24 is reversely rotated while contacting the non-image area 10*a* of the photoreceptor web 10, damage to the image area of the photoreceptor web 10 can be prevented.

In step S180, it is determined whether the drip developer D is completely removed. The squeegee roller 24 is sequentially lowered by colors in a lowering period $D_2$ and the charging of the photoreceptor web 10 is turned off. Simultaneously, the photoreceptor web 10 circulating during a decelerating proceeding period $S_2$ after the development mode period D/M is stopped and thus, the printing operation is terminated.

After printing is terminated, a small amount of developer remains at a portion where the squeegee roller 24 and the squeegee blade 26 contact. However, according to the method of the present invention, as toner particles are transferred to the development roller 22 in step S140, the remaining developer includes toner particles of 1.0–1.1 wt % only relatively less than the conventional technology which barely causes a problem.

As described above, in a developer cleaning method for a liquid electrophotographic printer according to the present invention, contamination of the photoreceptor web or the transfer roller through the photoreceptor web in the subsequent development mode can be sharply reduced so that print quality is improved.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A developer cleaning method for a liquid electrophotographic printer comprising the steps of:

(a) developing an electrostatic latent image by supplying developer supplied from an injection nozzle to a photoreceptor medium via a development roller;

(b) removing developer remaining between the injection nozzle and the development roller;

(c) removing drip developer formed on the photoreceptor web between a squeegee roller and the development roller; and (d) reducing an electrical potential of the development roller after development so that toner particles included in the drip developer are transferred to the development roller due to a difference in electrical potential;

wherein said step (d) comprises the steps of:

maintaining a constant charged electrical potential of the photoreceptor web; and making the electrical potential difference between the development roller and the photoreceptor web to be equal to or greater than the electrical potential difference between the development roller and the electrostatic latent image.

2. The method as claimed in claim 1, wherein said step of making the electrical potential difference between the development roller and the photoreceptor web to be equal to or greater, comprises a step of turning off the electrical potential applied to the development roller.

3. The method as claimed in claim 1, wherein said step of removing developer remaining between the injection nozzle and the development roller comprises the steps of:

continuously driving the photoreceptor web and the development roller after supply of the developer is terminated;

transferring the developer remaining between the injection nozzle and the development roller to the development roller; and removing the transferred developer by a brush roller and a cleaning blade contacting the development roller.

4. The method as claimed in claim 3, wherein the photoreceptor web circulates at least one turn.

5. A developer cleaning method for a liquid electrophotographic printer comprising the steps of:

(a) developing an electrostatic latent image by supplying developer supplied from an injection nozzle to a photoreceptor medium via a development roller;

(b) removing drip developer formed on the photoreceptor web between a squeegee roller and the development roller; and (c) reducing an electrical potential of the development roller after development so that toner particles included in the drip developer are transferred to the development roller due to a difference in electrical potential;

wherein said step (b) comprises the steps of:

lowering the development roller such that the development roller cannot contact the drip developer;

decelerating the preceding speed of the photoreceptor web;

reducing a pressing force against the photoreceptor web by the squeegee roller;

allowing a squeegee blade for removing developer on the outer circumferential surface of the squeegee roller to contact the squeegee roller; and reversing the squeegee roller.

6. The method as claimed in claim 5, wherein in said reversing squeegee roller step, the squeegee roller is reversed only when it contacts a non-image area of the photoreceptor web.

* * * * *